US007013655B2

(12) United States Patent
Des Champs

(10) Patent No.: US 7,013,655 B2
(45) Date of Patent: Mar. 21, 2006

(54) METHOD AND SYSTEMS TO PROVIDE PRE-ENGINEERED COMPONENTS AND CUSTOM DESIGNED COMPONENTS TO SATISFY THE REQUIREMENTS OF AN ENGINEERED AIR CONDITIONING SYSTEM

(75) Inventor: Nicholas H. Des Champs, Las Vegas, NV (US)

(73) Assignee: Entrodyne Corporation, Natural Bridge Station, VA (US)

( * ) Notice: Subject to any disclaimer, the term of this patent is extended or adjusted under 35 U.S.C. 154(b) by 0 days.

(21) Appl. No.: 10/868,761

(22) Filed: Jun. 17, 2004

(65) Prior Publication Data

US 2005/0279114 A1 Dec. 22, 2005

(51) Int. Cl.
*F25B 45/00* (2006.01)

(52) U.S. Cl. ..... 62/77; 62/92; 62/298

(58) Field of Classification Search ..... 62/90, 62/92, 93, 95, 96, 271, 314, 414, 419, 77
See application file for complete search history.

(56) References Cited

U.S. PATENT DOCUMENTS

| | | | | |
|---|---|---|---|---|
| 4,113,004 | A * | 9/1978 | Rush et al. | 165/7 |
| 4,173,924 | A * | 11/1979 | Bradshaw | 454/52 |
| 4,367,787 | A * | 1/1983 | Bradshaw | 165/222 |
| 4,487,034 | A * | 12/1984 | Cronin et al. | 62/402 |
| 4,841,733 | A * | 6/1989 | Dussault et al. | 62/93 |
| 5,003,961 | A * | 4/1991 | Besik | 126/110 R |
| 5,507,141 | A * | 4/1996 | Stigsson | 60/775 |
| 5,782,104 | A * | 7/1998 | Sami et al. | 62/271 |
| 6,199,388 | B1 * | 3/2001 | Fischer, Jr. | 62/90 |
| 6,378,604 | B1 * | 4/2002 | Feind et al. | 165/166 |
| 6,385,985 | B1 * | 5/2002 | Bussjager et al. | 62/259.1 |
| 6,751,964 | B1 * | 6/2004 | Fischer | 62/94 |
| 2002/0164944 | A1 * | 11/2002 | Haglid | 454/228 |

FOREIGN PATENT DOCUMENTS

| | | | |
|---|---|---|---|
| JP | 10-26369 | A * | 1/1998 |
| JP | 2002-340370 | A * | 11/2002 |

* cited by examiner

*Primary Examiner*—Mohammad M. Ali
(74) *Attorney, Agent, or Firm*—Oliff & Berridge, PLC

(57) ABSTRACT

A method to manufacture an engineered air-conditioning system that satisfies desired air-conditioning specifications, the engineered air-conditioning system including a refrigeration component coupled to at least one of an energy recovery system and an indirect evaporative cooling system, the method comprising: pre-determining a plurality of pre-engineered refrigerated air conditioning units as a plurality of standard refrigeration components, each component satisfying a different air conditioning specification; selecting one of the standard refrigeration components that substantially satisfies the desired air conditioning specification; custom designing at least one of the energy recovery system and the indirect evaporative cooling system to satisfy the desired air conditioning specification; and assembling the selected standard refrigeration components with at least one of the custom designed energy recovery system and indirect evaporative cooling system to create the engineered air conditioning system that satisfies the desired air condition specification without having to custom design the refrigerated air conditioning unit.

10 Claims, 6 Drawing Sheets

METHOD AND SYSTEMS TO PROVIDE PRE-ENGINEERED COMPONENTS AND CUSTOM DESIGNED COMPONENTS TO SATISFY THE REQUIREMENTS OF AN ENGINEERED AIR CONDITIONING SYSTEM

BACKGROUND OF THE INVENTION

1. Field of Invention

This invention relates to methods that simplify the design of systems that were previously custom-designed. The methods provide pre-engineered and manufactured modular components that may be used to satisfy specified requirements and that were previously custom-designed, and coupling those pre-engineered components with simpler custom engineered and manufactured components. In particular, this invention relates to an engineered air conditioning system made up of pre-engineered components as well as components that are used to satisfy specified requirements by being custom-designed, built, and added to the pre-engineered components, after the specified requirements are determined.

2. Description of Related Art

Air-conditioning is a process that simultaneously conditions air; distributes it to the conditioned space; and at the same time controls and maintains the required space's temperature, humidity, air movement, air cleanliness, sound level, and pressure differential within predetermined limits for the health and comfort of the occupants, for product processing, or both.

The acronym HVAC&R stands for heating, ventilating, air-conditioning, and refrigerating. The combination of these processes is equivalent to the functions performed by air-conditioning.

An air-conditioning or HVAC&R system includes components and equipment arranged in sequential order to heat or cool, humidify or dehumidify, clean and purify, attenuate objectionable equipment noise, transport the conditioned outdoor air and recirculated air to the conditioned space, and control and maintain an indoor or enclosed environment at optimum energy use.

In many industries, a specifying engineer determines a customer's requirements and the supplier of the equipment will custom manufacture the equipment to satisfy those customer requirements. In particular, in the construction industry, a new building or renovations for an existing building will be designed. Typically, once a proposed final layout of the building is determined, a specifying engineer works with the customer to determine the specific requirements of the HVAC&R system. Then a custom air-conditioning unit is conceived to meet the customer's specific need. The specifying engineer then makes technical schematics of the equipment. Included with the schematics are dimensions, weights, air flow performance, sound levels, air-conditioning and heating capacities, sizes of fans and motors, voltage, maximum electrical current, and specifications on materials and techniques of construction. Also included are control sequences that indicate to the user how and when the equipment is to operate in order to satisfy the requirements of the specific air-conditioning application.

Once the customer and the specifying engineer agree on a design that will meet the customer's needs and the overall building design is complete, the mechanical part of the job, which includes the HVAC equipment, goes out for bid by the manufacturers of HVAC equipment. Once the successful manufacturer is selected, a purchase order is placed. In order for a manufacturer/supplier to properly bid a custom-made air-conditioning product, it is imperative that the total labor hours to produce the product be known and that all parts, pieces, and components, and their costs and delivery times, be taken into account.

Typically, the time allowed a supplier of the custom air-conditioning equipment to arrive at a price to quote is very short—on the order of days and not weeks. In addition, the customer is expecting a price for this custom equipment that is only slightly higher than the standard, pre-designed equipment and a delivery time that is also comparable to that of standard equipment. Therefore, the greater the database of component costs and delivery times, labor costs from prior similar jobs, and previous designs that can modified or drawn from, the better off a supplier will be in meeting the customer's needs and also in meeting the supplier's own profit goals.

SUMMARY OF THE INVENTION

This invention goes one step further than the related art modular design, by treating the most complicated parts of the air conditioning system as a pre-engineered, pre-designed component. The simpler parts of the invention that allow the system to be "uniquely engineered" to meet the exacting requirements of the application are left to be designed on a job-by-job basis. For example, when the systems of the invention are released for manufacture, the Bill Of Materials (BOM) that accompanies the systems of the invention work order will list an "SRC 35/10" (Standard Refrigeration Component having 35 tons of refrigeration capability and an air-flow of 10,000 CFM) that will essentially reduce the items in the systems of the invention BOM by hundreds of parts. With the systems and methods of the invention, a purchasing department will be purchasing 60% of the total job material just by filling in the one line that says "SRC 35/10" instead of hundreds of lines for motors, belts, drives, controllers, fans, spring isolators, condensers, filters, compressors, electrical wire, fasteners, coils, valves, thermal insulation, copper, steel, etc.

An aspect of the invention redefines the term "component" as it would normally be used in an air conditioning product context to mean a pre-engineered unit that was previously custom-built based on the customer's specific requirements. "Pre-engineered" is intended to mean units that are pre-designed to satisfy different requirements. For example, a pre-engineered SRC 35/10 has 35 tons of refrigeration capacity and an airflow of 10,000 CFM, while a pre-engineered SRC 25/5 has 25 tons of refrigeration capacity and an airflow of 5,000 CFM. Different pre-engineered units satisfy different requirements for refrigeration capacity and airflow. "Custom designed", "custom built", "custom components", or "custom engineered" is intended to mean units that are not pre-engineered, but instead are designed and built to match the specific requirements (i.e., designed and/or built "post-specification" when the specific requirements are already known).

This invention provides systems and methods to provide an engineered air-conditioning system including pre-engineered components to which custom components are added to satisfy an air-conditioning specification.

This invention provides systems and methods to provide a pre-engineered Standard Refrigeration Component (SRC) having an air handling unit including, but not limited to, a supply fan, motor, cooling coil, air filter and associated parts to which custom components are added to satisfy an air-conditioning specification. A standard configuration of the SRC may also include electronic controls, a water-cooled condenser, and refrigerant compressors.

This invention provides systems and methods to provide air-conditioning equipment including pre-engineered components to which custom engineered and manufactured energy recovery systems and/or an indirect evaporative cooling system is added.

This invention provides systems and methods to provide a pre-engineered SRC having an air handling unit as well as a heater, such as an indirect gas fired heater, to which custom components are added to satisfy an air conditioning specification.

This invention provides systems and methods to provide a pre-engineered SRC having an air handling unit as well as a condenser, such as a water cooled condenser or an air cooled condenser, to which custom components are added to satisfy an air conditioning specification.

This invention, when supplied with a water-cooled, air-conditioning condenser, may use sump water from the indirect evaporative cooling heat exchanger to remove heat from the air-conditioning cycle. This is accomplished by:

a. Cooling the recirculated water by evaporative cooling similar to the way it is typically done in a sprayed cooling tower. Specifically, as the water is sprayed downward through airfoil tubes in a counter-flow direction to scavenge air flowing upward, also through the air-foil tube, the water has energy removed from it as air evaporates moisture from the water's surface;

b. The cooled water then flows downward, leaving the tubes and dropping into the water-collecting sump directly beneath the indirect evaporative heat exchanger; and c. The cooled, sump water is then pumped to a water-cooled refrigerant condenser where it picks up heat from the hot refrigerant gas, thereby causing the hot refrigerant gas to condense. The heated water then either goes through a hot water reheat coil and then back to be sprayed into the top of the indirect evaporative cooler or directly back to the indirect evaporative cooler or a combination of each flow path.

This invention provides systems and methods to provide pre-engineered SRCs in a plurality of sizes and capacities, to which custom engineered and manufactured components are added to satisfy an air conditioning specification.

Although the following descriptions are directed to an air conditioning system, it should be appreciated that the systems and methods described below may be practiced with any manufactured system. Thus, the description of the air conditioning system is exemplary and is not intended to limit the scope of the invention.

DETAILED DESCRIPTION OF EXEMPLARY EMBODIMENTS

Figure 1:
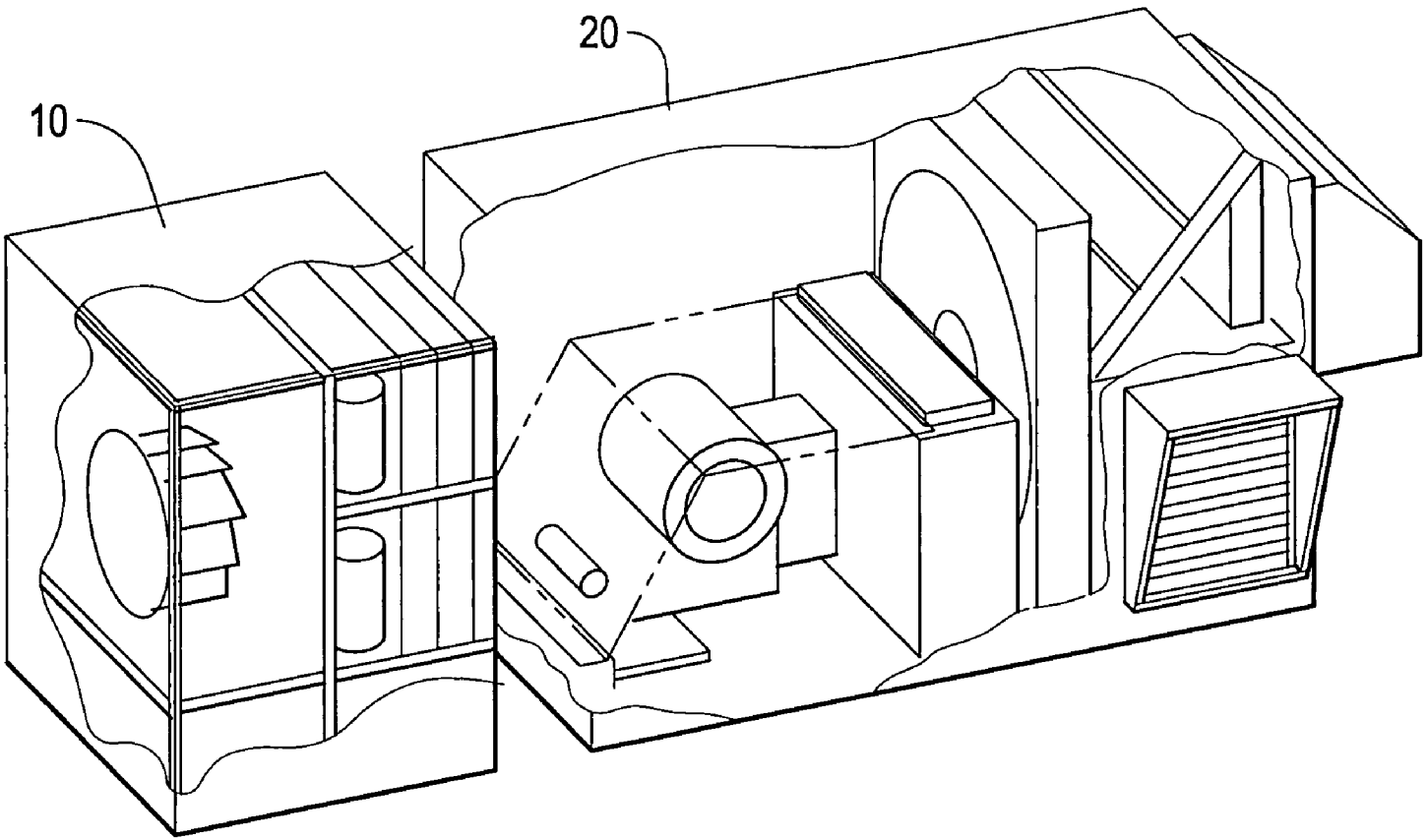
FIG. 1 is an exemplary embodiment of an engineered air-conditioning system according to an exemplary embodiment of the invention.

FIG. 1 is a schematic of a standard refrigeration component (SRC) 10, according to an exemplary embodiment of the invention. According to the systems and methods of the invention, an SRC may be an air handling unit including a supply fan, motor, cooling coil, compressors, water-cooled condenser, air filter and associated parts. These parts are pre-engineered and pre-assembled to form the SRC. Furthermore, the pre-engineered SRC is manufactured in a variety of suitable sizes and can include a variety of standard options such as heating coil, water-side economizer coil, chilled water coil, and refrigerant reheat coil. Each of the various sizes of the SRCs will be enabled to provide various air conditioning capacities in order to meet or substantially meet the predetermined system requirements of an air conditioning system.

Figure 2:
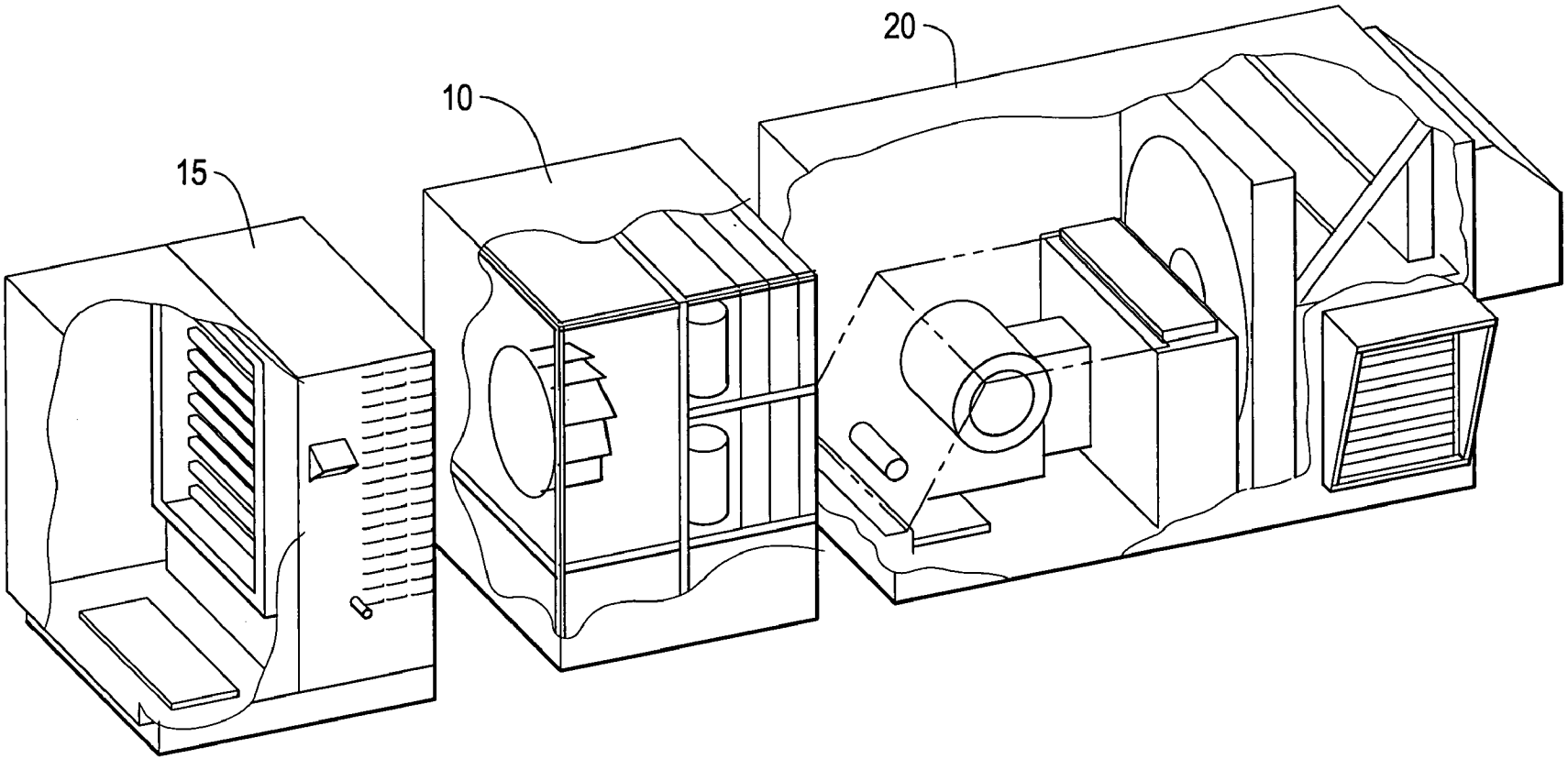
FIG. 2 is an exemplary embodiment of an engineered air-conditioning system according to an exemplary embodiment of the invention.
Figure 3:
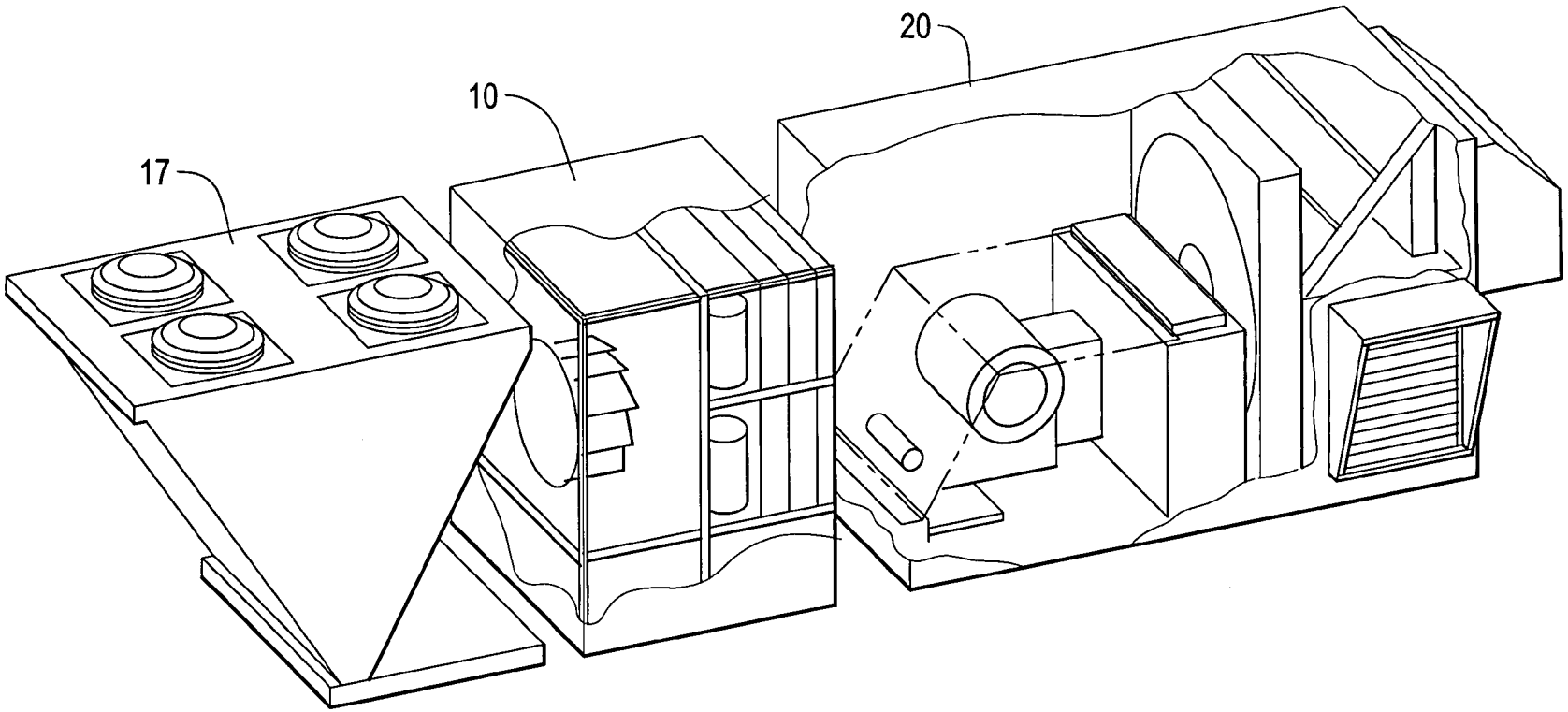
FIG. 3 is an exemplary embodiment an engineered air-conditioning system according to an exemplary embodiment of the invention.

For example, a pre-engineered and manufactured SRC could be provided in seven sizes. For instance, an SRC that provides 30 tons of refrigeration and 10,000 cubic feet per minute (CFM) of air, 60 tons of refrigeration and 20,000 CFM of air, and so on, up to 100 tons of refrigeration and 35,000 CFM and so on. The pre-engineered SRC may also include a condenser such as a water cooled condenser as shown in FIG. 1. Other pre-engineered standard components such as an Indirect-fired Gas Heater as shown in FIG. 2 or an Air-Cooled Condenser as shown in FIG. 3 could be added to the system if the equipment specification requires such components.

The specification for an engineered air conditioning system may require 32 tons of refrigeration and 9,000 cubic feet per minute of air. The application engineer can choose a standard refrigeration component "SRC" based on a size that closely matches the air conditioning system requirements. Thus, if a standard refrigeration component is provided in seven sizes, as discussed above, to satisfy a requirement for 32 tons of refrigeration and 9,000 cubic feet per minute of air, the unit having 35 tons of air conditioning and 10,000 cubic feet per minute of air would be chosen.

However, as shown above, the SRC chosen may not meet all of the requirements of the air conditioning system. Thus, depending on the shortfall of the SRC, a custom designed and built supplemental component, such as an energy recovery system and/or an indirect or indirect/direct evaporative cooling system may be added to the system to satisfy the air conditioning specification requirements. The energy recovery system and/or indirect evaporative cooling system is designed and built to supplement the heating and/or cooling requirements of the SRC in order to meet the full system heating and cooling requirements. In the example above, the energy recovery system and/or indirect evaporative cooling would be designed to add X tons of cooling and X BTUs of heating by means of pre-cooling or pre-heating the air within the energy recovery section or the indirect/direct evaporative cooler before it gets to the SRC in order to meet full system requirements.

In FIG. 1, an energy recovery system 20 is added to the SRC 10 in order to make up for the difference between the capabilities of the SRC and the requirements of the air conditioning specifications.

Thus, once the specification for the air conditioning system is determined, a substantial portion of the system thermal requirements may be satisfied by choosing an SRC 10 that is closest to the meeting the system demand. Instead of custom manufacturing the entire air conditioning system, only a small portion of the system needs to be custom made.

FIG. 2 is a schematic of a SRC 10 according to an exemplary embodiment of the invention. In FIG. 2 the SRC is pre-engineered to include heater 15. Heater 15 may be an indirect gas fired heater or any other suitable heating system. In FIG. 2, the SRC has been sized so that is necessary to custom build and add energy recovery system 20 to satisfy the air conditioning specifications.

FIG. 3 is a schematic of a SRC 10 according to an exemplary embodiment of the invention. In FIG. 3, the SRC is pre-engineered to include air-cooled condenser 17. Although FIG. 3 depicts an air-cooled condenser, any suitable condenser, such as a water cooled condenser may be included in the SRC. As in FIG. 2, the SRC is sized so that it is necessary to add energy recovery system 20 to satisfy the air conditioning specifications.

Figure 4:
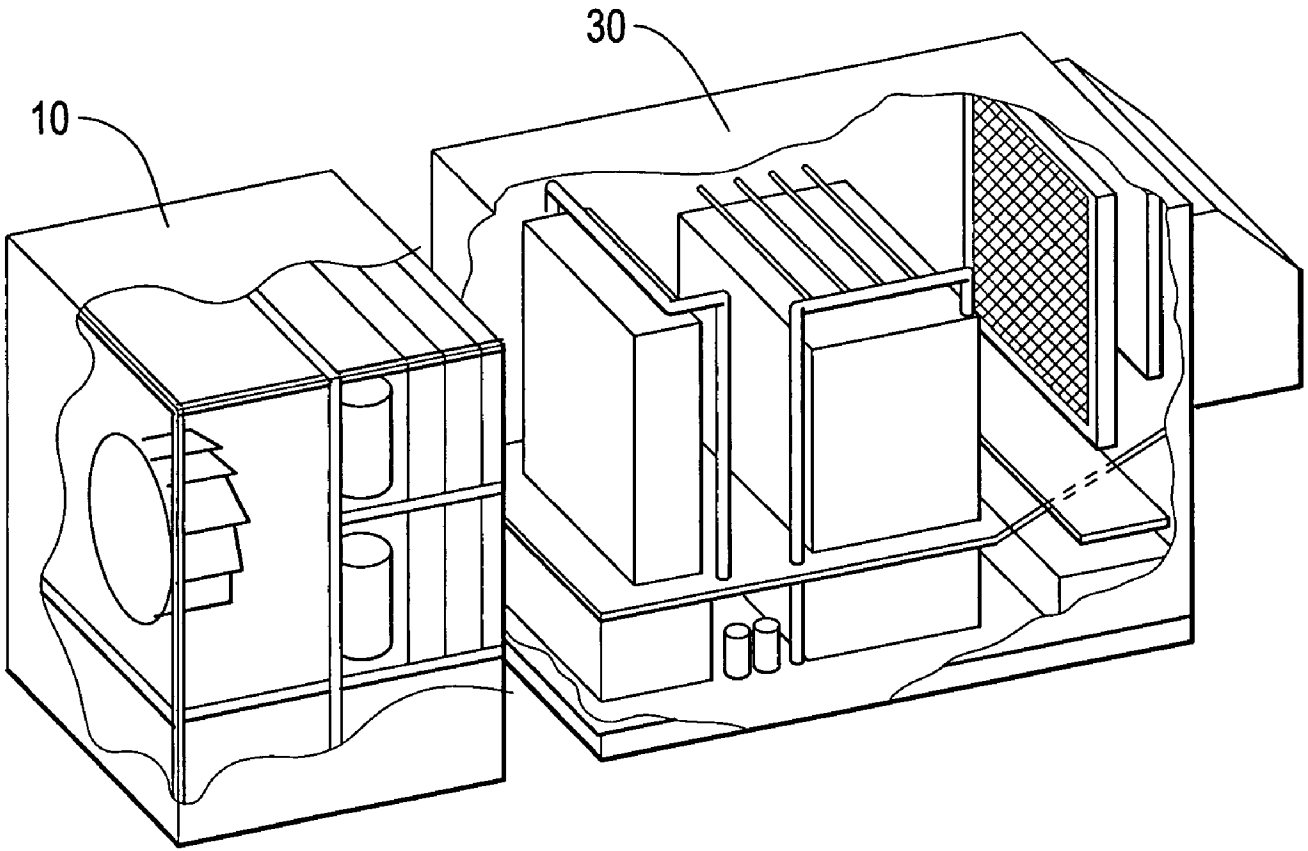
FIG. 4 is an exemplary embodiment an engineered air-conditioning system according to an exemplary embodiment of the invention.

FIG. 4 is a schematic of a SRC according to an exemplary embodiment of the invention. In FIG. 4, the SRC is only an air handling unit. However, it should be appreciated that an SRC according to an exemplary embodiment of the invention may include a heater 15 and/or a condenser as shown in FIGS. 2 and 3. Furthermore, it should be appreciated that the SRC may include any other suitable HVAC&R system as a pre-engineered and manufactured portion of the SRC.

In FIG. 4, the SRC has been sized so that it is necessary to custom build an indirect evaporative cooling or direct evaporative cooling 30 or a combination of indirect and direct evaporative cooling to satisfy the air conditioning specification. It should be appreciated that in addition to the indirect evaporative cooling or direct evaporative cooling any other suitable HVAC&R system as a custom engineered and manufactured system may be added to the SRC to satisfy air conditioning specifications.

For example, the SRC may be part of a system that has an energy recovery system added as in FIGS. 1–3, or a system that has indirect evaporative cooling or direct evaporative cooling added as in FIG. 4. However, energy recovery and indirect/direct evaporative cooling may be part of the SRC as the pre-engineered portion of the system. In another exemplary embodiment of the invention, the energy recovery system, the indirect/direct evaporative cooling system and additional custom manufactured HVAC&R systems may be added to the pre-engineered SRC to satisfy the air conditioning system requirements.

Figure 5:
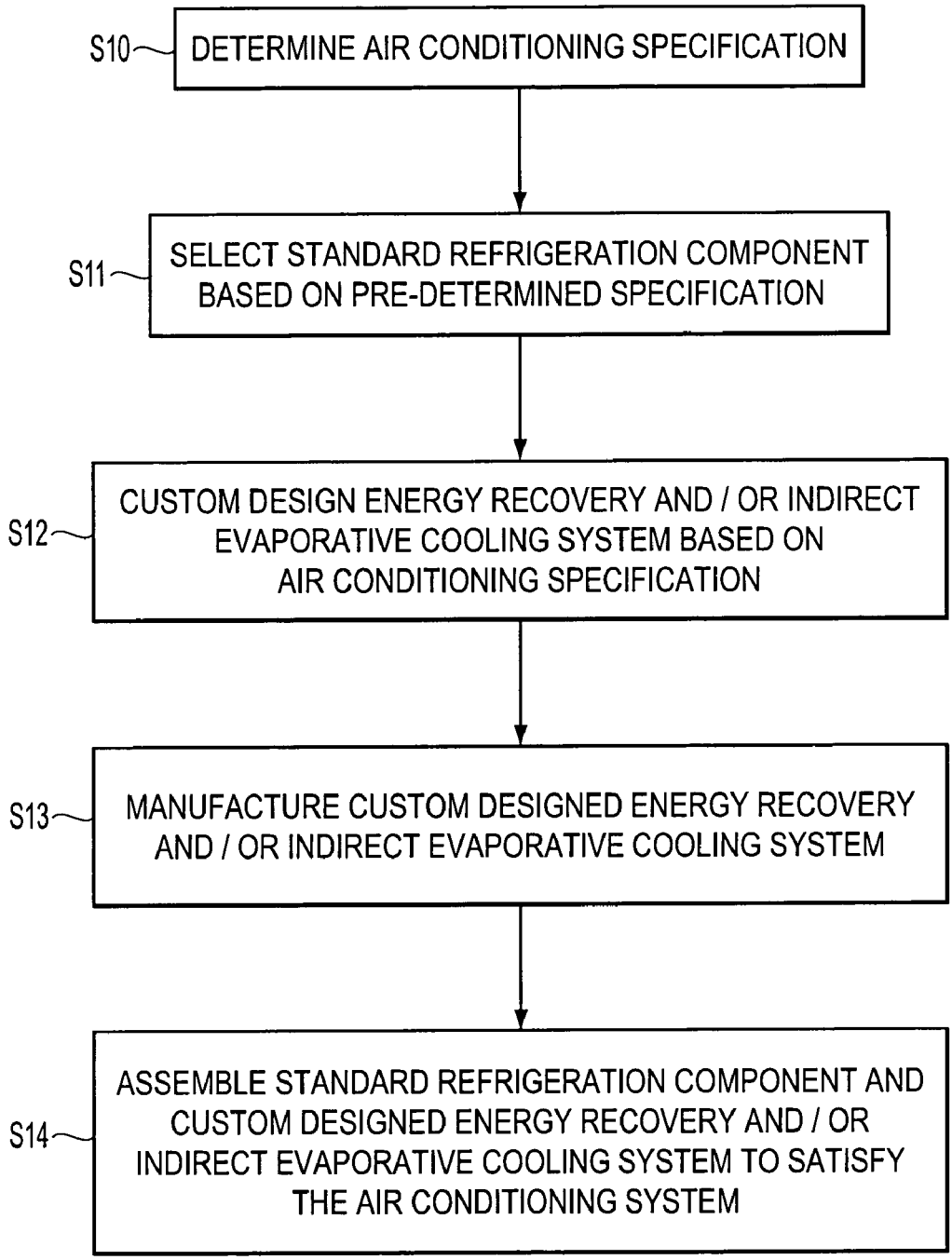
FIG. 5 is a flow chart of a method of satisfying the requirements of an engineered air conditioning system according to an exemplary embodiment of the invention.

FIG. 5 is an exemplary embodiment of the method of the invention as applied to an air conditioning system. In S10, an applications engineer evaluates the air conditioning requirements of a structure, for example, using the criteria described the Description of Related Art.

In S10, the engineer establishes specifications based on all the criteria. The specification may include such criteria as heating and cooling load, amount of CFM required, permissible noise, requirements for humidifying and/or dehumidifying.

In S11, a SRC that comes closest to satisfying the specification established in S10 is chosen. In S12, the custom designed and built portion such as an Energy Recovery (ER) system and/or in Indirect Evaporative Cooling system (IEC) are designed to satisfy the shortcomings of the SRC in meeting the specification of the air conditioning system. In S13, the designed ER and/or IEC system is custom built, and in S14 the custom built system is combined with the pre-engineered SRC system to satisfy the air conditioning requirements of the system.

In another exemplary embodiment of the invention an engineered system or product may contain pre-engineered components built to be off the shelf components and components that are post custom engineered and built to satisfy the specification requirements. Normally, the most complex components will be pre-engineered. However, the components that are custom engineered and built should be components that change the characteristic of the manufactured product to the extent that there is sufficient flexibility to satisfy various specific demands. A careful examination of each product must be conducted to determine an optimum balance of pre-engineered components and custom engineered and built components.

Figure 6:
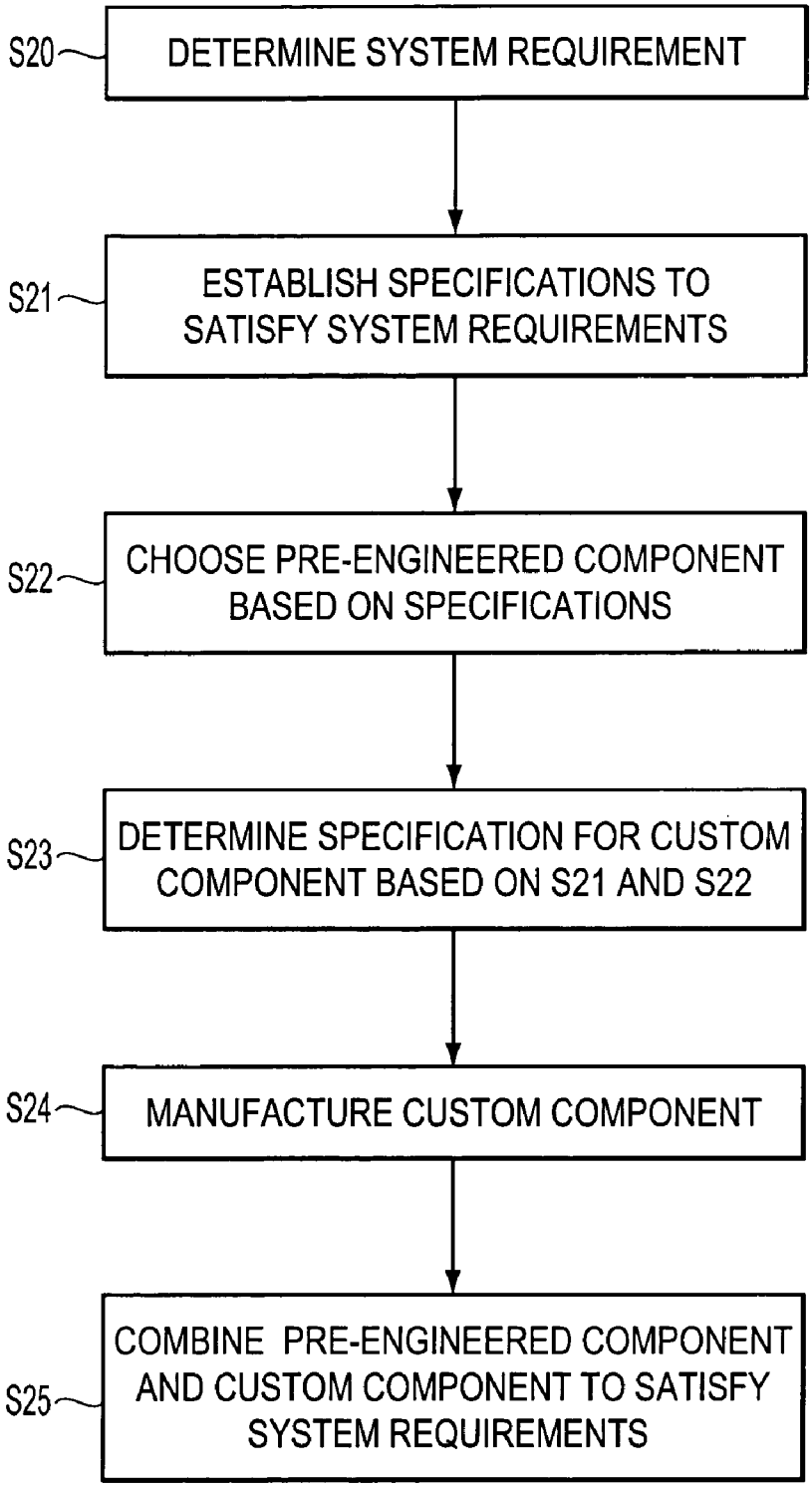
FIG. 6 is a flow chart of a method of satisfying the requirements of an engineered system according to an exemplary embodiment of the invention.

FIG. 6 is a flow chart according to an exemplary embodiment of the invention. In FIG. 6, the systems and methods of the invention are applied to a system or structure that is designed and built to meet a specific requirement. In S20, the system requirements are determined. A specification may be prepared that reflects the system requirements in S21. A provider of the components that are made to satisfy the system requirements may have a plurality of components. The plurality of pre-engineered components may be prepared based on a myriad of criteria that are associated with the system requirements. A pre-engineered component is chosen in S22 based on its ability to substantially satisfy the system requirements. The shortfall between the capabilities of the pre-engineered component and the system requirements is determined. In S23, the shortfall is used to determine a specification of the custom component. In S26 the custom component is manufactured to meet the specification determined in S23. In S25, the chosen pre-engineered component is combined with the custom component to satisfy the system requirements.

While the invention has been described with reference to exemplary embodiments, it is to be understood that the invention is not limited to the exemplary embodiments or constructions. While the various elements of the exemplary embodiments are shown in various combinations and configurations, which are exemplary, other combinations and configurations, including more, less or only a single element, are also within the spirit and scope of the invention.

What is claimed is:

1. A method to manufacture an engineered air-conditioning system that satisfies desired air-conditioning specifications, the engineered air-conditioning system including a refrigeration component coupled to at least one of an energy recovery system and an indirect evaporative cooling system, the method comprising:

pre-determining a plurality of pre-engineered refrigerated air conditioning units as a plurality of standard refrigeration components, each component satisfying a different air conditioning specification;

selecting one of the standard refrigeration components that substantially satisfies the desired air conditioning specification;

custom designing at least one of the energy recovery system and the indirect evaporative cooling system to satisfy the desired air conditioning specification;

manufacturing at least one of the energy recovery system and the indirect evaporative cooling system; and assembling the selected standard refrigeration components with at least one of the manufactured energy recovery system and indirect evaporative cooling system to create the engineered air conditioning system that satisfies the desired air condition specification without having to custom design the refrigerated air conditioning unit.

2. The method of claim 1, wherein the custom designing of the at least one of the energy recovery system and the indirect evaporative cooling system supplements the selected standard refrigeration components.

3. The method of claim 1, wherein the custom designing of the at least one of the energy recovery system and the indirect evaporative cooling system compensates for a difference between capabilities of the selected standard refrigeration components and the desired air-conditioning specifications.

4. A method to manufacture an engineered air-conditioning system that satisfies desired air-conditioning specifications, the engineered air-conditioning system including a refrigeration component coupled to at least one of an energy recovery system, an indirect/direct evaporative cooling system, a direct evaporative cooling system, a condenser system, and a heater system the method comprising:

pre-determining a plurality of pre-engineered refrigerated air conditioning units as a plurality of standard refrigeration components, each component satisfying a different air conditioning specification;

selecting one of the standard refrigeration components that substantially satisfies the desired air conditioning specification;

custom designing a custom system including at least one of the energy recovery system, the indirect/direct evaporative cooling system, the direct evaporative cooling system, the condenser system, and the heater system to satisfy the desired air conditioning specification;

manufacturing the custom system; and assembling the selected standard refrigeration components with the custom system to create the engineered air conditioning system that satisfies the desired air condition specification without having to custom design the refrigerated air conditioning unit.

5. The method of claim 4, wherein the custom designing of the custom system supplements the selected standard refrigeration components.

6. The method of claim 4, wherein the custom designing of the system compensates for a difference between capabilities of the selected standard refrigeration components and the desired air-conditioning specifications.

7. A method to manufacture an engineered air-conditioning system that satisfies desired air-conditioning system requirements, the engineered air-conditioning system including a refrigeration component coupled to at least one of an energy recovery system component, an indirect evaporative cooling system component, an indirect/direct evaporative cooling system component, a direct evaporative cooling system component, a condenser system component, and a heater system component the method comprising:

establishing one or more pre-engineered specifications that substantially satisfies the desired air-conditioning system requirements;

choosing one or more pre-engineered components that substantially satisfies the desired air-conditioning system requirement;

determining custom specifications for one or more custom components based on the desired air-conditioning system requirements and the selected pre-engineered components, the one or more custom components including at least one of the refrigeration component, the energy recovery system component, the indirect evaporative cooling system component, the indirect/direct evaporative cooling system, the direct evaporative cooling system component, the condenser system component, and the heater system component;

manufacturing the one or more custom components based on the determined custom specifications; and assembling the selected pre-engineered components with the manufactured custom components that satisfies the desired air-conditioning specifications without having to custom design the pre-engineered components.

8. The method of claim 7, wherein the determining the custom specifications supplements the selected pre-engineered components.

9. The method of claim 7, wherein the determining the custom specifications compensates for a difference between capabilities of the selected pre-engineered components and the desired air-conditioning system requirements.

10. The method of claim 7, wherein choosing the one or more pre-engineered components is selecting a pre-engineered refrigerated air-conditioning unit.

* * * * *